US012440019B2

(12) United States Patent
Bernard

(10) Patent No.: US 12,440,019 B2
(45) Date of Patent: Oct. 14, 2025

(54) MAGNETIC TACTICAL APPAREL AND VEHICLE ATTACHMENTS

(71) Applicant: Erik Howard Bernard, Georgetown, TX (US)

(72) Inventor: Erik Howard Bernard, Georgetown, TX (US)

( * ) Notice: Subject to any disclaimer, the term of this patent is extended or adjusted under 35 U.S.C. 154(b) by 75 days.

(21) Appl. No.: 18/440,500

(22) Filed: Feb. 13, 2024

(65) Prior Publication Data

US 2025/0143441 A1 May 8, 2025

Related U.S. Application Data

(60) Provisional application No. 63/485,755, filed on Feb. 17, 2023.

(51) Int. Cl.
*A45F 5/02* (2006.01)
*A41F 1/00* (2006.01)

(52) U.S. Cl.
CPC ..... *A45F 5/02* (2013.01); *A41F 1/002* (2013.01)

(58) Field of Classification Search
CPC ..... A45F 5/02; A41F 1/002
See application file for complete search history.

(56) References Cited

U.S. PATENT DOCUMENTS 5,926,925 A * 7/1999 Hicks ..... A41B 11/002 24/303
6,163,889 A * 12/2000 Tate ..... A63B 57/353 2/209.13
8,695,935 B1 * 4/2014 Kasbohm ..... F41A 23/18 42/99
9,763,510 B1 * 9/2017 Miner ..... A41F 1/002
10,141,092 B2 * 11/2018 Bennett ..... F41C 33/041
10,161,732 B2 * 12/2018 Purkiss ..... F41A 9/65
10,232,790 B1 * 3/2019 Adrain ..... B60R 7/14
10,244,806 B2 * 4/2019 Marks ..... A41F 1/002
10,480,711 B1 * 11/2019 Tran ..... A45F 5/02
10,627,178 B2 * 4/2020 Hofleitner ..... E05B 47/0045
10,634,931 B1 * 4/2020 Zargari ..... G02C 5/143
10,702,001 B2 * 7/2020 Morgan ..... A42C 2/00
10,973,310 B2 * 4/2021 Vlassis ..... A45F 3/14
11,002,510 B2 * 5/2021 Sitz ..... F41C 33/041
11,136,813 B2 * 10/2021 Rush ..... G09F 7/20
11,348,713 B2 * 5/2022 McMillan, II ..... H04B 1/385
11,696,634 B2 * 7/2023 Schori ..... A41D 27/20 224/183
11,747,110 B2 * 9/2023 Kozak ..... F41C 33/048 224/183
11,925,301 B1 * 3/2024 Hayward ..... A47L 13/41
2005/0102802 A1 * 5/2005 Sitbon ..... A45C 13/1069 24/303
2007/0039141 A1 * 2/2007 Rairden ..... E05C 19/16 24/303

(Continued)

*Primary Examiner* — Khaled Annis
(74) *Attorney, Agent, or Firm* — Steven R. Fairchild

(57) ABSTRACT

The present invention relates to securing tactical gear for use in the field. It could be secured to a field operative, such as personnel involved with a military, law enforcement, or emergency response. Alternatively, it can be secured to the vehicle utilized by such personnel. The present invention utilizes magnet to secure the equipment to the garment worn by the personnel, including helmets, belts and tactical or the vehicles used by the same people.

8 Claims, 17 Drawing Sheets

(56) References Cited

U.S. PATENT DOCUMENTS

2008/0087785 A1* 4/2008 Roche ..... A47B 81/005 248/309.4
2009/0289090 A1* 11/2009 Fullerton ..... A45F 5/02 224/183
2010/0167619 A1* 7/2010 Adamus ..... A41D 27/08 446/72
2012/0153740 A1* 6/2012 Soar ..... F41H 1/02 307/104
2012/0216374 A1* 8/2012 Manuello ..... A41F 1/002 24/303
2013/0254976 A1* 10/2013 Aravena ..... F41C 33/00 224/183
2013/0326789 A1* 12/2013 Lehrman ..... A41D 19/0034 2/160
2014/0088338 A1* 3/2014 Chang ..... A43B 7/00 600/15
2014/0182088 A1* 7/2014 Roberts ..... A45F 5/02 24/303
2015/0173427 A1* 6/2015 Sawyer ..... A41D 15/002 2/67
2015/0200045 A1* 7/2015 Mathieu ..... A45F 5/02 335/286
2015/0377578 A1* 12/2015 Tucker ..... F41A 23/18 248/316.1
2016/0007722 A1* 1/2016 Macon ..... A45F 5/06 2/93
2016/0254083 A1* 9/2016 Bennett ..... A45F 5/02 335/285
2017/0127813 A1* 5/2017 Calman ..... H01F 7/0252
2018/0049493 A1* 2/2018 Graves ..... A45F 5/021
2018/0238671 A1* 8/2018 Purkiss ..... F41A 9/70
2019/0210538 A1* 7/2019 Adrain ..... B60R 7/14
2019/0372268 A1* 12/2019 Sitbon ..... H01R 11/30
2020/0328771 A1* 10/2020 McMillan, II ..... H04M 1/04
2021/0037904 A1* 2/2021 Macfarlane ..... A41F 1/002
2021/0052059 A1* 2/2021 McMillan, II ..... H04M 1/04
2021/0307495 A1* 10/2021 Schori ..... A41F 1/002
2023/0027392 A1* 1/2023 Welintukonis ..... F41C 33/0227
2023/0143251 A1* 5/2023 Yoskowitz ..... A41D 13/0153 2/455
2025/0143441 A1* 5/2025 Bernard ..... A45F 5/02

* cited by examiner

MAGNETIC TACTICAL APPAREL AND VEHICLE ATTACHMENTS

CROSS REFERENCE TO RELATED APPLICATION

This application claims the benefit of U.S. Provisional Patent Application No. 63/485,755 titled "MAGNETIC TACTICAL APPAREL" filed by the applicant on Feb. 17, 2023, which is incorporated herein by reference in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present invention relates to tactical apparel and vehicle attachments for use by military, law enforcement, or rescue personnel.

DESCRIPTION OF THE RELATED ART

Securing equipment is a necessity for highly physically-intense professional services, such as military, law enforcement, or rescue personnel. These trained professionals regularly carry heavy gear into the field, which they must use in stressful times without a second thought as to keeping the gear on the person or in their transport vehicle.

The weight of the full gear can be enormous. It is common for a soldier to carry over 100 pounds of material into the field. Such immense weight must primarily be distributed to the body and not carried by the arms or shoulders. Otherwise, the soldier's arms would tire and he (or she) would be unable to lift the equipment to use it.

Likewise, the attachment must be strong enough to both support the weight of the equipment and withstand the riggers and stresses of field operations.

To avoid these problems, tactical gear is typically secured on personnel with the assortment of strap attachments. These straps need to made of strong, but flexible material, such as polyethylene fibers. These straps may further connect to equipment pouches to hold smaller items, such as radios or ammunition clips.

However, a problem arises when tactical gear must be quickly donned or removed. The field operative must undue the connecting straps, which can take precious moments of time when every second counts.

Gear is typically stored or attached to vehicles through the use of metal compartments that are welded onto the frame of the vehicle. Removal of the equipment can be difficult, time-consuming, and require specialized equipment, such as blow-torches.

The present invention overcomes all these drawbacks in the prior art.

SUMMARY OF THE INVENTION

Embodiments of the present invention utilize magnets provide an alternative method of securing gear. The present invention overcomes the drawbacks of the prior art. Not only is the present invention light-weight, but also provides strong attachment points for the gear that allow the gear to be quickly removed by the tactical operator.

A means for securing tactical equipment to a garment, comprising:

a garment that contains at least one first magnet, wherein said first magnet is embedded within said garment;

at least one piece of tactical equipment; and, at least one reciprocal magnetic attachment, where said reciprocal magnetic attachment is secured to said piece of tactical equipment.

The means for securing tactical equipment of ¶ [0012], wherein said reciprocal magnetic attachment is either a second magnet or a steel plate.

The means for securing tactical equipment of ¶ [0012], wherein said piece of tactical equipment is selected from the group consisting of a firearm, ammunition clip, set of binoculars, set of night vision goggles, radio equipment, or a thermal imaging device.

The means for securing tactical equipment of ¶ [0012], wherein said garment is selected from the group consisting of a helmet, a vest, a set of trousers, a shirt, or a vest.

The means for securing tactical equipment of ¶ [0012], wherein said first magnet is is composed of neodymium, boron, and iron.

The means for securing tactical equipment of ¶ [0012], wherein said first magnet is composed of samarium and cobalt.

A means for securing tactical equipment to a vehicle, comprising:

a vehicle frame;

at least one first magnet, wherein said first magnet is attached to said vehicle frame;

at least one piece of tactical equipment; and, at least one reciprocal magnetic attachment, where said reciprocal magnetic attachment is secured to said piece of tactical equipment.

The means for securing tactical equipment to a vehicle of ¶ [0018], wherein said reciprocal magnetic attachment is either a second magnet or a steel plate.

The means for securing tactical equipment to a vehicle of ¶ [0018], wherein said piece of tactical equipment is selected from the group consisting of a firearm, ammunition clip, set of binoculars, set of night vision goggles, radio equipment, or a thermal imaging device.

The means for securing tactical equipment to a vehicle of ¶ [0018], wherein said garment is selected from the group consisting of a helmet, a vest, a set of trousers, a shirt, or a vest.

The means for securing tactical equipment to a vehicle of ¶ [0018], wherein said first magnet is is composed of neodymium, boron, and iron.

The means for securing tactical equipment to a vehicle of ¶ [0018], wherein said first magnet is composed of samarium and cobalt.

DETAILED DESCRIPTION OF THE PRESENT INVENTION

Figure 1:
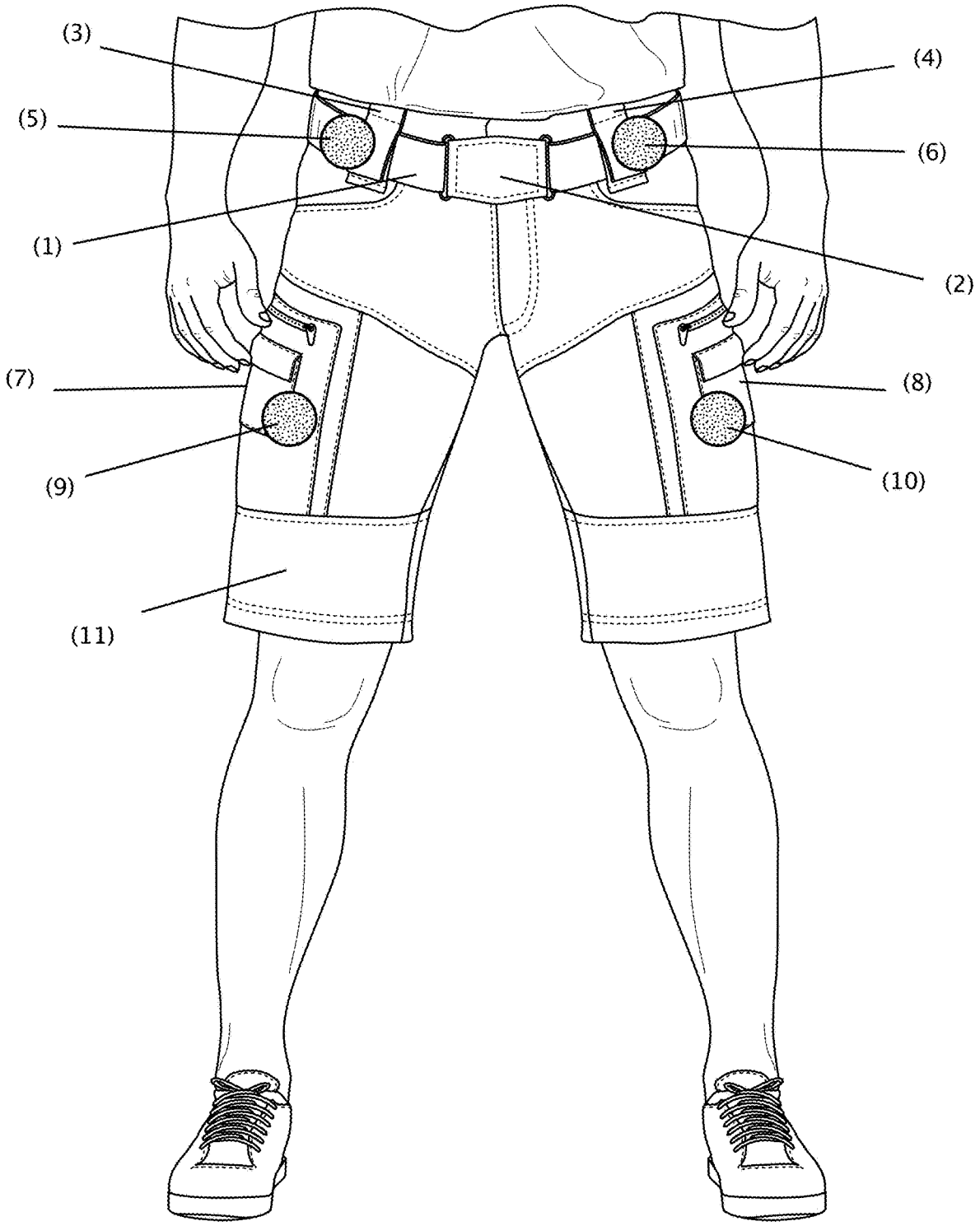
FIG. 1 shows the placement of the magnets on uniform shorts (front).

Embodiments of the present invention utilize magnets provide an alternative method of securing gear. Magnets are placed within the clothing and tactical gear worn by the field operative. Alternatively, magnets are secured around the frame of a vehicle.

In a preferred embodiment, a reciprocal magnetic attachment is then secured to the tactical gear item. A suitable magnetic attachment could include a magnet secured with a rubber mount or a small steel plate.

As used herein, tactical gear equipment includes, but is not limited to, the following pieces of equipment: body armor (bulletproof vests or plate carriers), night vision goggles, thermal imaging technology, weaponry (pistols and rifles), ammunition clips, communication devices, survival gear, knives and utility knives, hydration bottles, and the like.

As used herein, tactical gear clothing includes, but is not limited to, helmets. uniforms, shorts, shirts, gloves, knee pads, trousers, vests, belts, and the like.

As used herein, a vehicle frame includes, but is not limited to, doors, chassis frame, roll-bar, hood, door, and seats within the vehicle.

Compatible Fabrics

It is envisioned that magnets are themselves secured to straps and tactical gear garments, such as tactical vests or uniforms. In a preferred embodiment, these materials themselves have magnets secured within or attached thereto.

In a preferred embodiment, these fabric materials disrupt the magnetic field but are not magnetic themselves.

Examples of fabrics that are compatible with this invention include, but are not limited to the following: shielding military-grade faraday fabric 5G EMF protection, sold by REDEMPTION SHIELD®; 1.08 m Width RFID Anti-Magnetic Fabric, Conductive Electromagnetic Shielding Cloth, sold by NANSONG®; Copper Fabric Blocking RFID/RF Shielding Fabric, sold by ZHANGLI®; the single or double silver plated nylon fabric, such as the "Silver Supershield EMF Shielding" ™, RipStop Silver Fabric, High-Performance Silver Mesh Fabric; EMF shielding fabric sold by Swiss Shield® under the trade name "New Daylite"®, which is a blend of 78% polyester, 21% copper, and 1 silver; woven metallized polyester netting, such as the "HNG80 EMF Shielding Mesh"™, which is sold by YSHIELD®; cotton and silver fabric blends, such as the Cotton Grid™, sold by Filter EMF™ magnetic field shielding film MCL6; silverell fabric; stainless steel mesh shielding fabric; and the like.

Preferred Magnets

Preferred magnets that are compatible with this invention are made from rare earth metals. One example is composed of neodymium, boron, and iron. Another is composed of samarium and cobalt.

By themselves, they are extremely strong, although tend to be brittle and are vulnerable to corrosion. Thus, in a preferred embodiment, they are plated with nickel to prevent oxidation.

In a preferred embodiment, these magnets would have gauss ratings from 500-6000 Gauss.

In a preferred embodiment, the magnets are fashioned in the following shapes: nonagon, octagon, heptagon, hexagon, triangle, scalene triangle, right triangle, parallelogram, rhombus, square, pentagon, circle, oval, heart, cross, arrow, cube, cylinder, star, crescent, and the like.

In a preferred embodiment, the magnets are secured within the straps and tactical gear garments, such as tactical vests or uniforms.

In a preferred embodiment, reciprocal magnets are placed on the tactical equipment.

Preferred Metals

It is envisioned that some metals might be needed in association with the magnets and equipment. Preferred metals for use with this invention are those with non-magnetic properties.

These include, but are not limited to, AL60 wall shield and the like.

Tactical Equipment Modification

In a preferred embodiment, the tactical equipment is slightly modified to provide the best connection with the magnet. This occurs in two mechanisms.

The first method is to use a rubber mount to secure at least one reciprocal magnet on the equipment. Suitable magnets include those previously listed. This is the preferred method for lighter weight and smaller tactical gear items.

The second method is to attach at least one steel plate to the tactical gear item. The steel plate provides a natural magnetic connection with the magnet. This is the preferred method for heavier tactical gear items, including rifles.

Use in the Figures

Reference is made to FIGS. 1-17. The illustrations utilize a common numbering system where common item numbers refer to the same structure across all illustrations.

In a preferred embodiment, the magnets are placed around the clothing and garments of the tactical gear as worn by field operatives. The placement of these magnets is preferred to appropriately carry the tactical gear for optimal performance.

As shown in FIG. 1, Item (1) shows the belt worn and the belt buckle (Item (2)) worn by a uniformed soldier in cargo-style shorts, shown as Item (11). Item (3) shows the front right belt clasp of the shorts while Item (4) shows the front left belt clasp of the shorts. In preferred embodiment, the magnets are placed along the belt slightly lateral to the these two belt clasps. These are demonstrated by Items (5) and (6), which are the right and left magnet placements along the belt, respectively.

As further shown in FIG. 1, Items (7) and (8) refer to the right and left thigh-level pockets of the cargo-style shorts, respectively. In preferred embodiment, the magnets are placed over these pockets. These are demonstrated by Items (9) and (10), which are the right and left magnet placements over the thigh-pockets, respectively.

Figure 2:
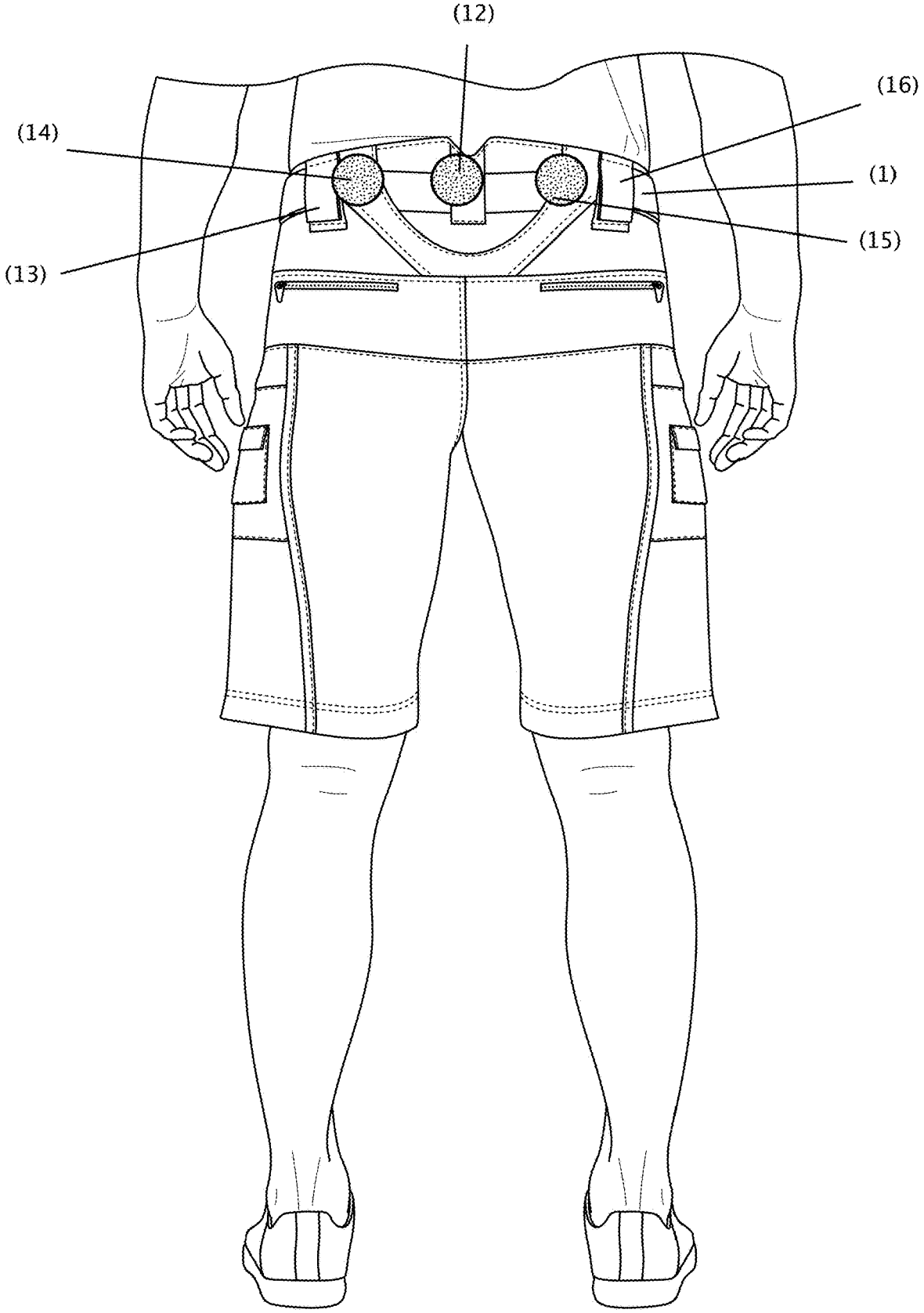
FIG. 2 shows the placement of the magnets on uniform shorts (rear).

As further shown in FIG. 2, Item (12) refers to the placement of the magnet on the belt (Item (1)) at the rear midline position of the body along the waist. Items (13) and (16) refer to the rear-left and rear-right straps along the belt (Item (1)), respectively. In a preferred embodiment, magnets are placed along belt at these positions, as designated by Items (14) and (15), respectively.

Figure 3:
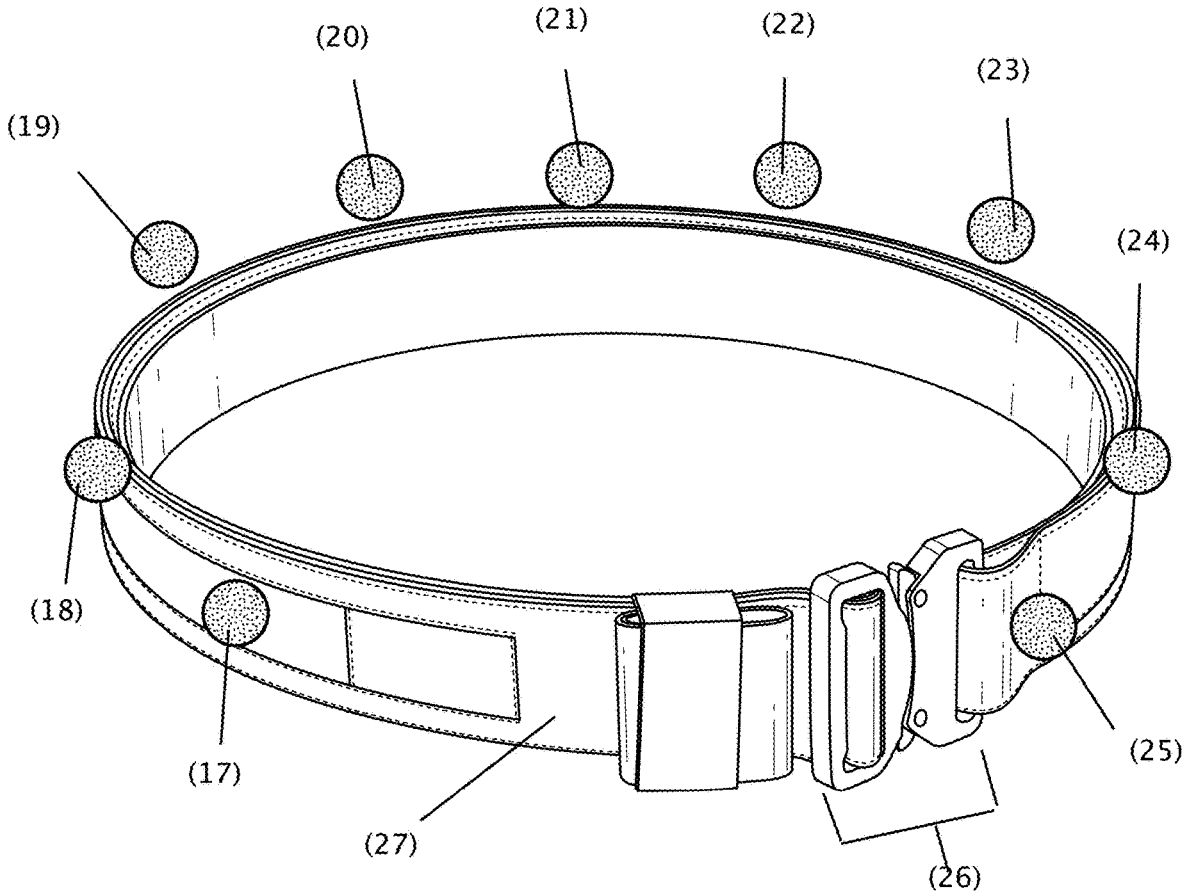
FIG. 3 shows the placement of the magnets on a uniform belt.

As further shown in FIG. 3, Item (27) designates a belt with a clasping structure, as shown in Item (26). Items (17), (18), (19), (20), (21), (22), (23), (24), and (25) designate nine positions along this belt structure for possible magnet attachments sites. It should be understood that although the shaded circles are not fully attached to the belt, these represent sites for attaching magnets to the belt.

Figure 4:
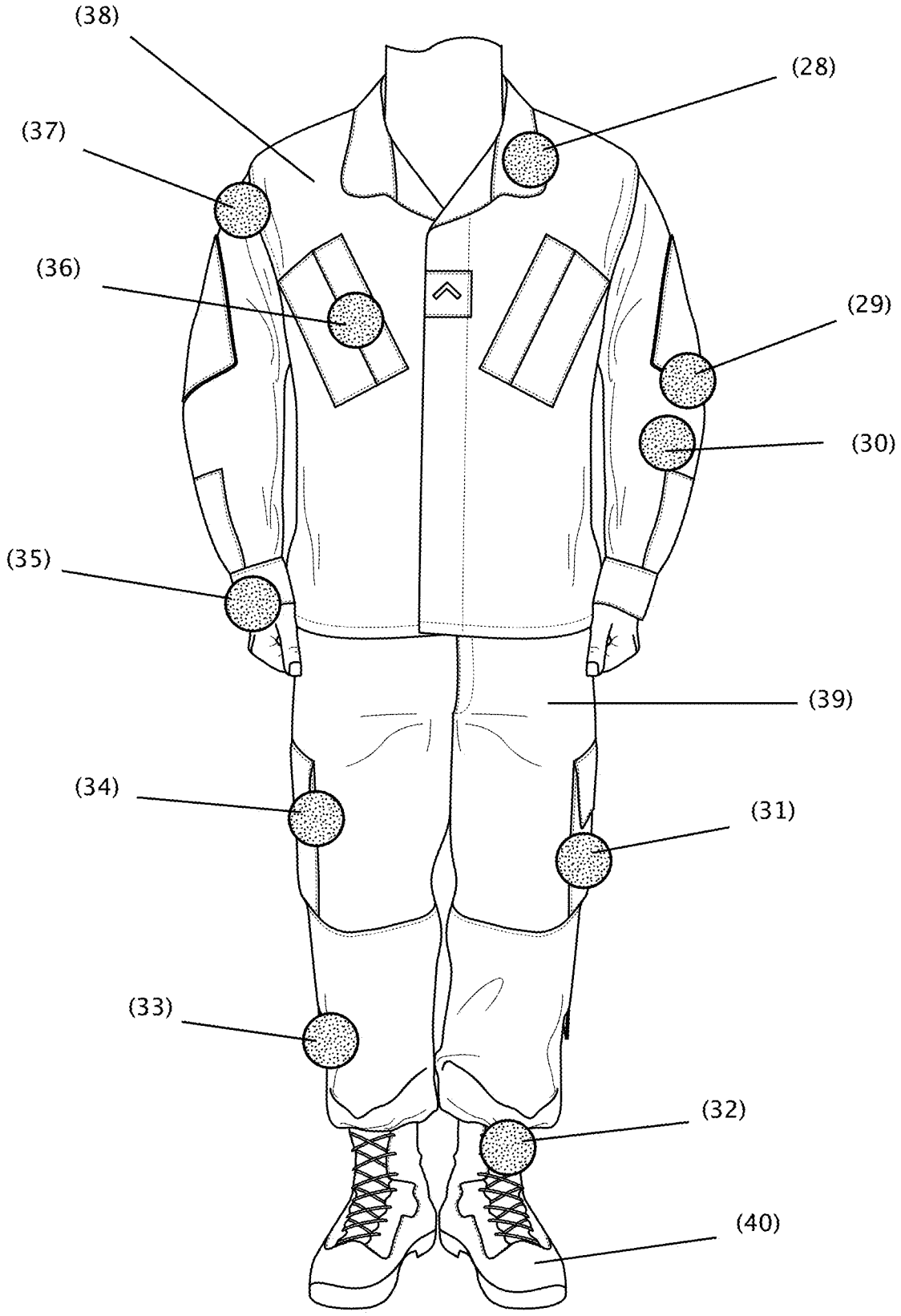
FIG. 4 shows the location of the magnets on a uniform.

As further shown in FIG. 4, the placement of magnets is shown a long-sleeve uniform shirt (Item (38), full-length trousers (Item (39)), and footwear (Item (40), the left boot). In particular, Item (28) designates the placement of a magnet on the left lapel of the long-sleeve uniform shirt. Item (29) designates the placement of a magnet on the left sleeve of the long-sleeve uniform shirt, around the elbow. Item (30) designates the placement of a magnet on the left sleeve of the long-sleeve uniform shirt, on the forearm. Item (31) designates the placement of a magnet on the left pant-leg of the full-length trousers, near the knee. Item (32) designates the placement of a magnet over the laces of the left boot (Item (40)). In a preferred embodiment, the boot is modified with an external support strap that covers the laces to enable securement of the magnet.

Item (33) designates the placement of a magnet on the right pant-leg of the full-length trousers, on the lateral side of the calf muscles.

Item (34) designates the placement of a magnet on the right pant-leg of the full-length trousers, on the level of the thigh.

Item (35) designates the placement of a magnet on the right sleeve of the long-sleeve uniform shirt, at the wrist.

Item (36) designates the placement of a magnet on the long-sleeve uniform shirt, above the right breast pocket.

Item (37) designates the placement of a magnet on the long-sleeve uniform shirt, on the right shoulder.

It should be understood that although the Items on FIG. 4 designate a particular side of the uniform, the placement of the magnet can also be added to the opposite side of the uniform.

Figure 5:
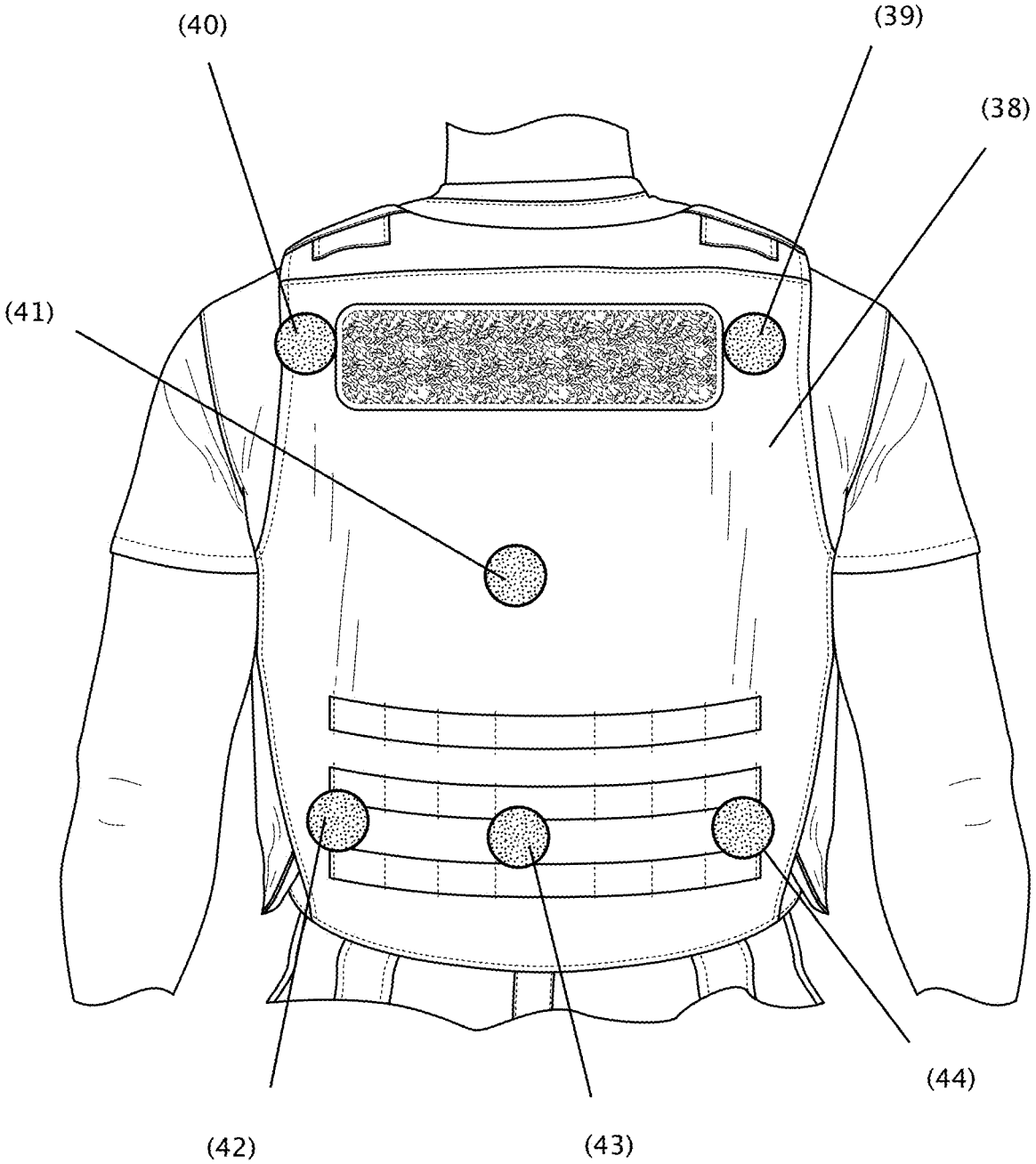
FIG. 5 shows the placement of the magnets on a body armor vest (rear).

As shown in FIG. 5, the magnets can be placed on the rear side of a tactical vest, shown as Item (38). Items (39) an (40) designate the placement of magnets on the upper-right and upper-left of the back of the tactical vest, respectively. Item (41) designates the placement of a magnet in the center of the back of the tactical vest. Items (42), (43), and (44) designate the placement of magnets on the bottom-left, center, and bottom-right of the back of the tactical vest, respectively.

Figure 6:
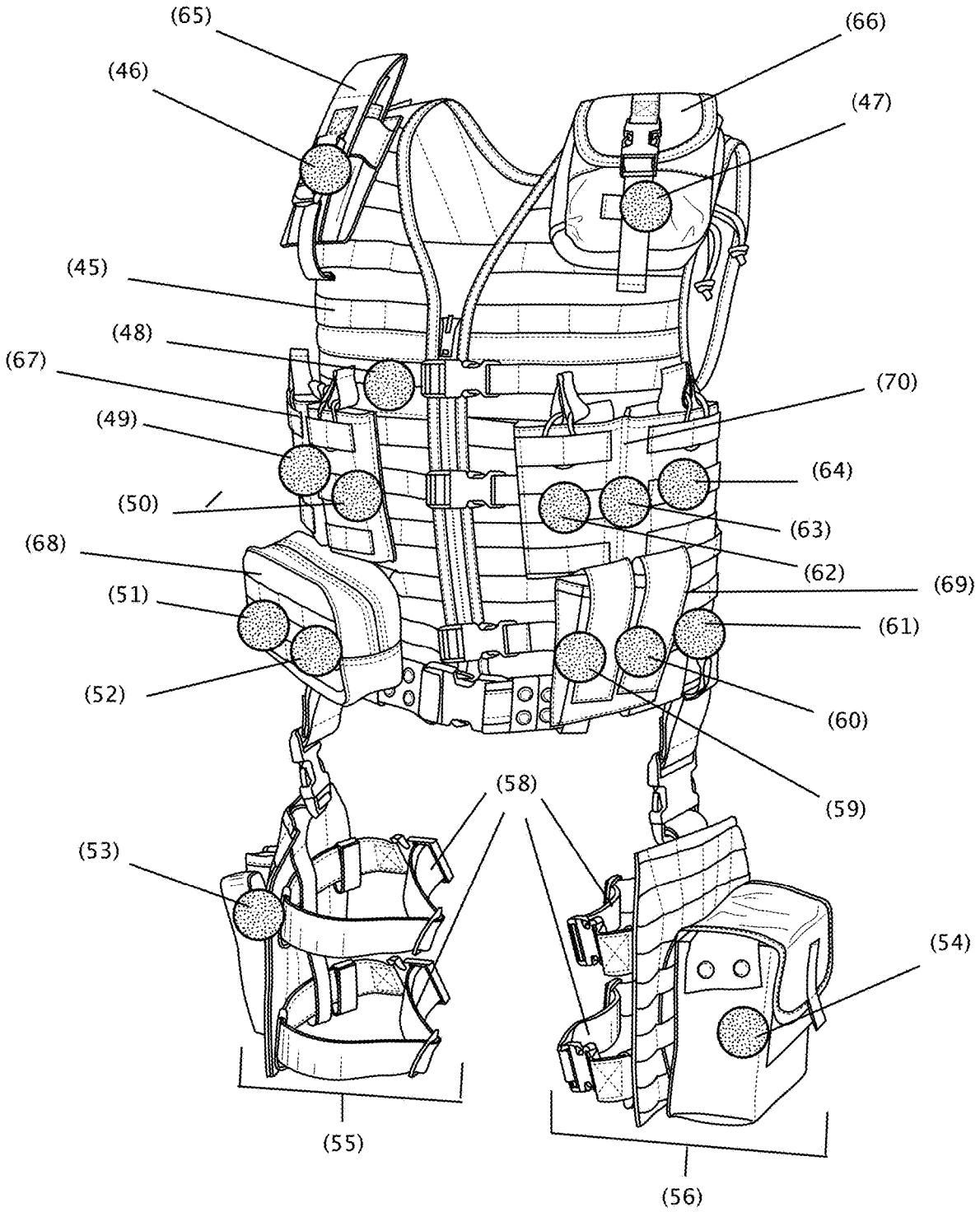
FIG. 6 shows the placement of the magnets on a tactical vest (front).

As shown in FIG. 6, the magnets can be placed on the rear side of a tactical vest, shown as Item (45). Items (46) and (47) designate the placement of the magnets over the right (Item (65)) and left (Item (66)) clavicle attachment pouch on the tactical vest, respectively.

Item (48) designates the placement of the magnet over the central, solar plexus region of the tactical vest.

Items (49) and (50) designate the right and left placement of the magnets over the right middle attachment pouch (Item (67)) of the tactical vest, respectively.

Items (51) and (52) designate the right and left placement of the magnets over the right lower attachment pouch (Item (68)) of the tactical vest, respectively.

Item (53) designates a placement of the magnet over the right leg attachment accessory (Item (55)) of the tactical vest, respectively. Item (54) designates a placement of the magnet over the left leg attachment accessory (Item (56)) of the tactical vest, respectively. Item (58) designates a series of four straps that attach the two leg attachment accessories to the thighs of the person wearing the tactical vest.

Items (59), (60), and (61) designate the right, center, and left placement of the magnets over the left lower attachment pouch (Item (69)) of the tactical vest, respectively.

Items (62), (63), and (64) designate the right, center, and left placement of the magnets over the left middle attachment pouch (Item (70)) of the tactical vest, respectively.

Figure 7:
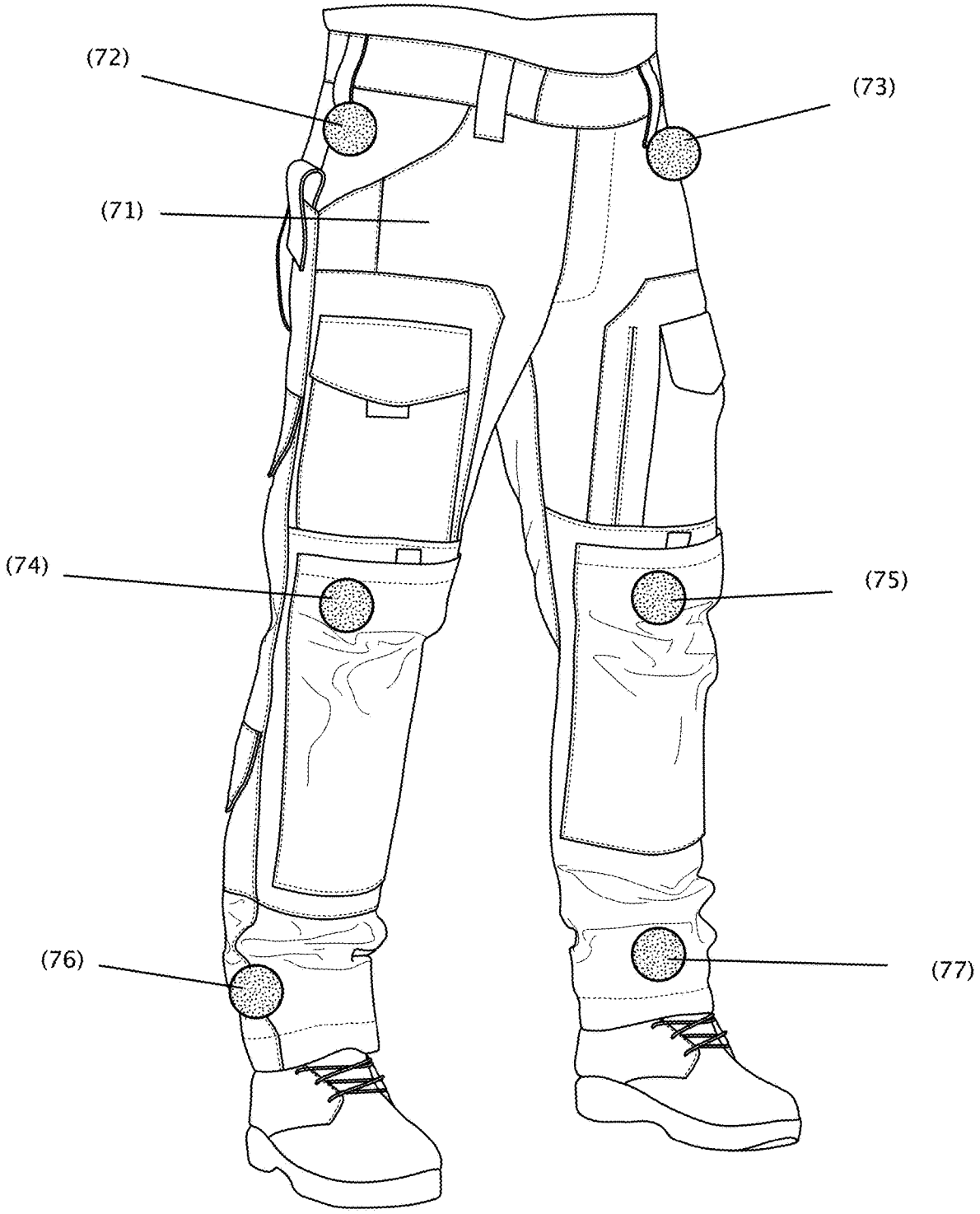
FIG. 7 shows the placement of the magnets on uniform pants.

As shown in FIG. 7, the magnets can be placed over various points on the front side of utility cargo trousers, shown in Item (71). Items (72) and (73) designate magnet placement sites over the right and left side of the hip of the utility cargo trousers, respectively. Items (74) and (75) designate magnet placement sites over the right and left knee areas of the utility cargo trousers, respectively. Items (76) and (77) designate magnet placement sites over the right and left ankle areas of the utility cargo trousers, respectively.

Figure 8:
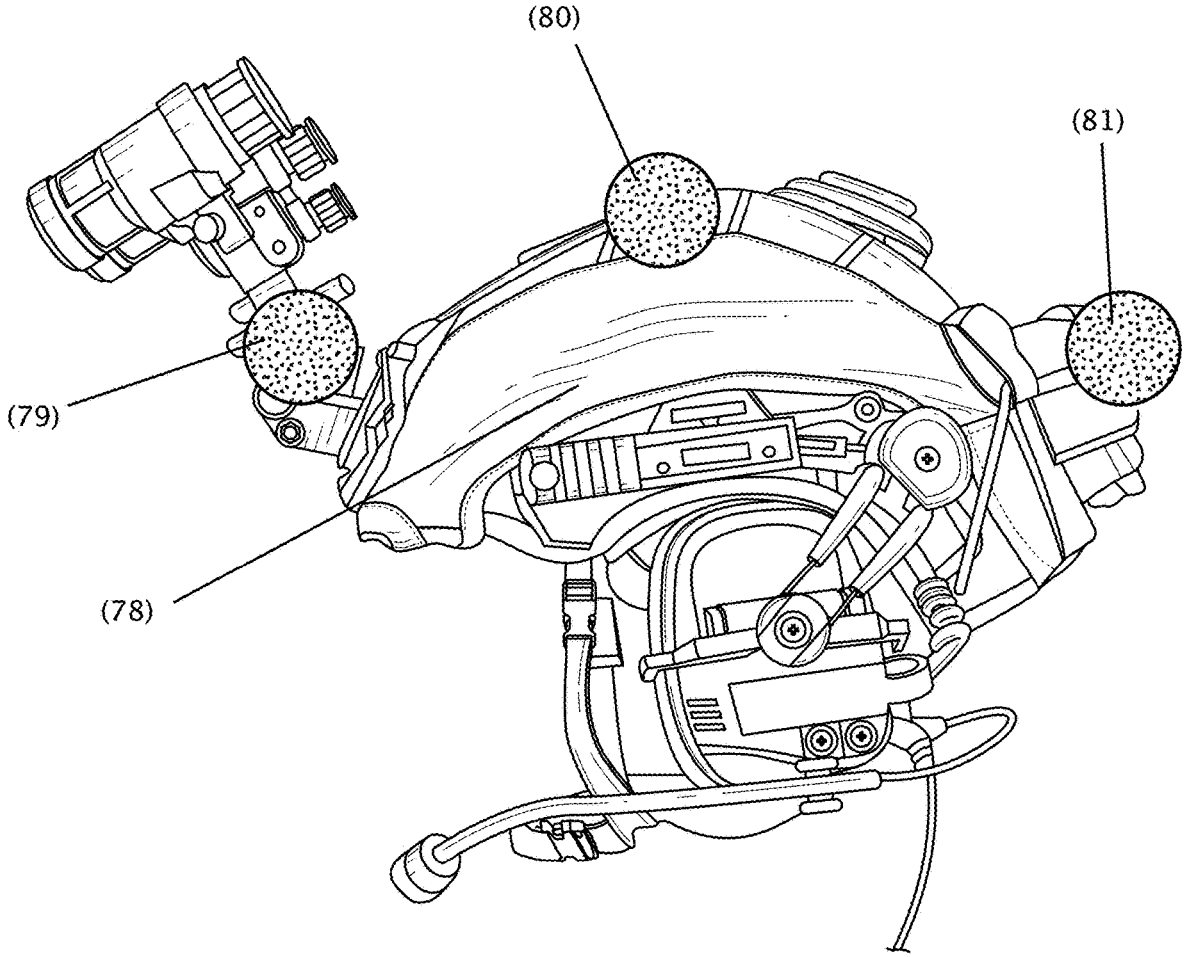
FIG. 8 shows the placement of the magnets on a tactical helmet.

As shown in FIG. 8, the magnets can be placed over various points on a tactical helmet (Item (78)). Item (79) designates a magnet placement site at the support for the helmet binoculars. Item (80) designates a magnet placement site in the middle of the helmet. Item (81) designates a magnet placement site at the rear of the helmet.

Figure 9:
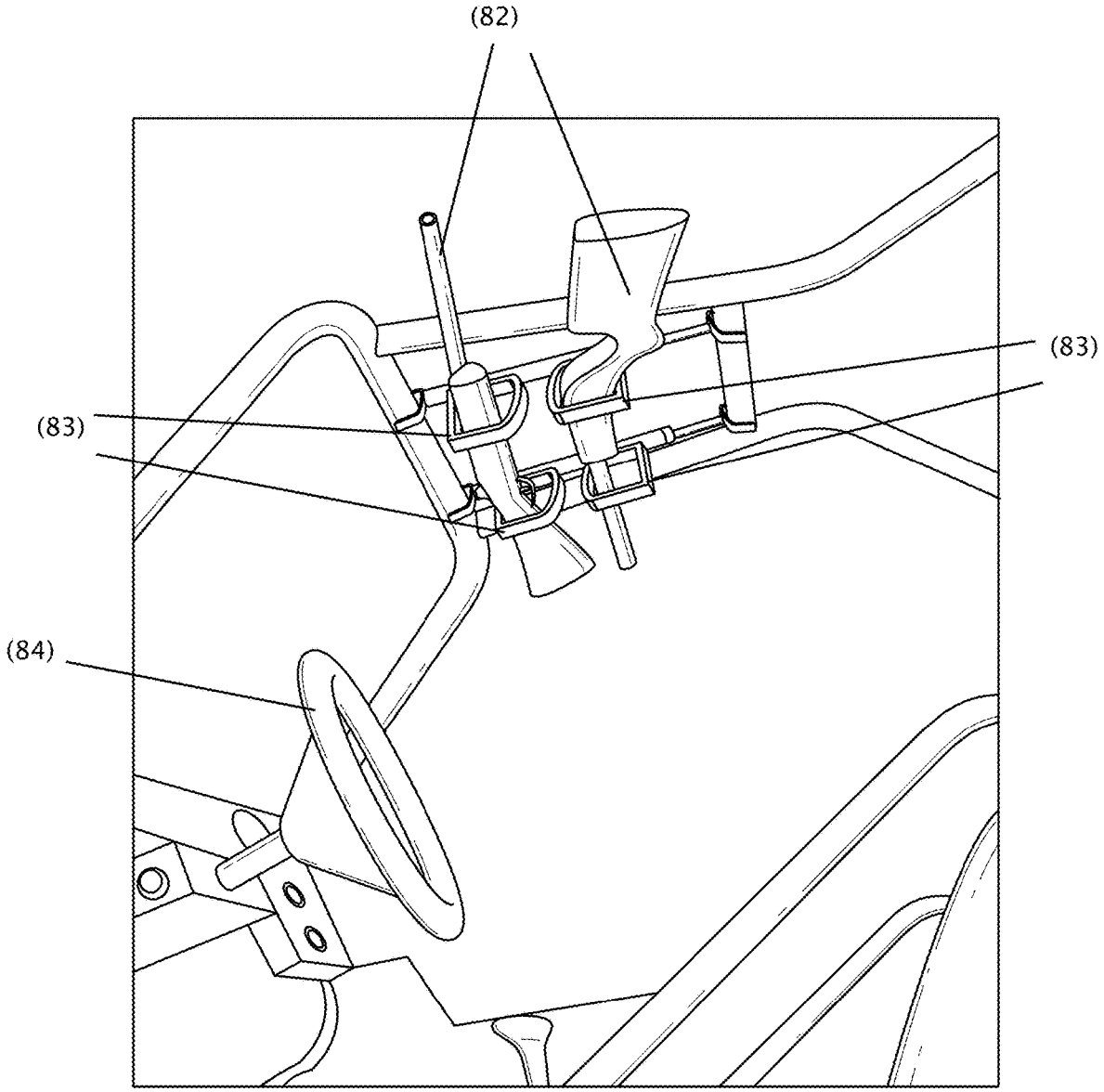
FIG. 9 shows equipment using the magnets on a vehicle's roll-bar

FIG. 9 shows the attachment point for several rifles under the roll bars of an open cockpit vehicle. For reference, the steering wheel is identified as Item (84). Item (82) designates the two rifles while Item (83) designates the four securement attachment points for the same rifles. In a preferred embodiment of the present invention, these four securements points are replaced with securement magnets.

Figure 10:
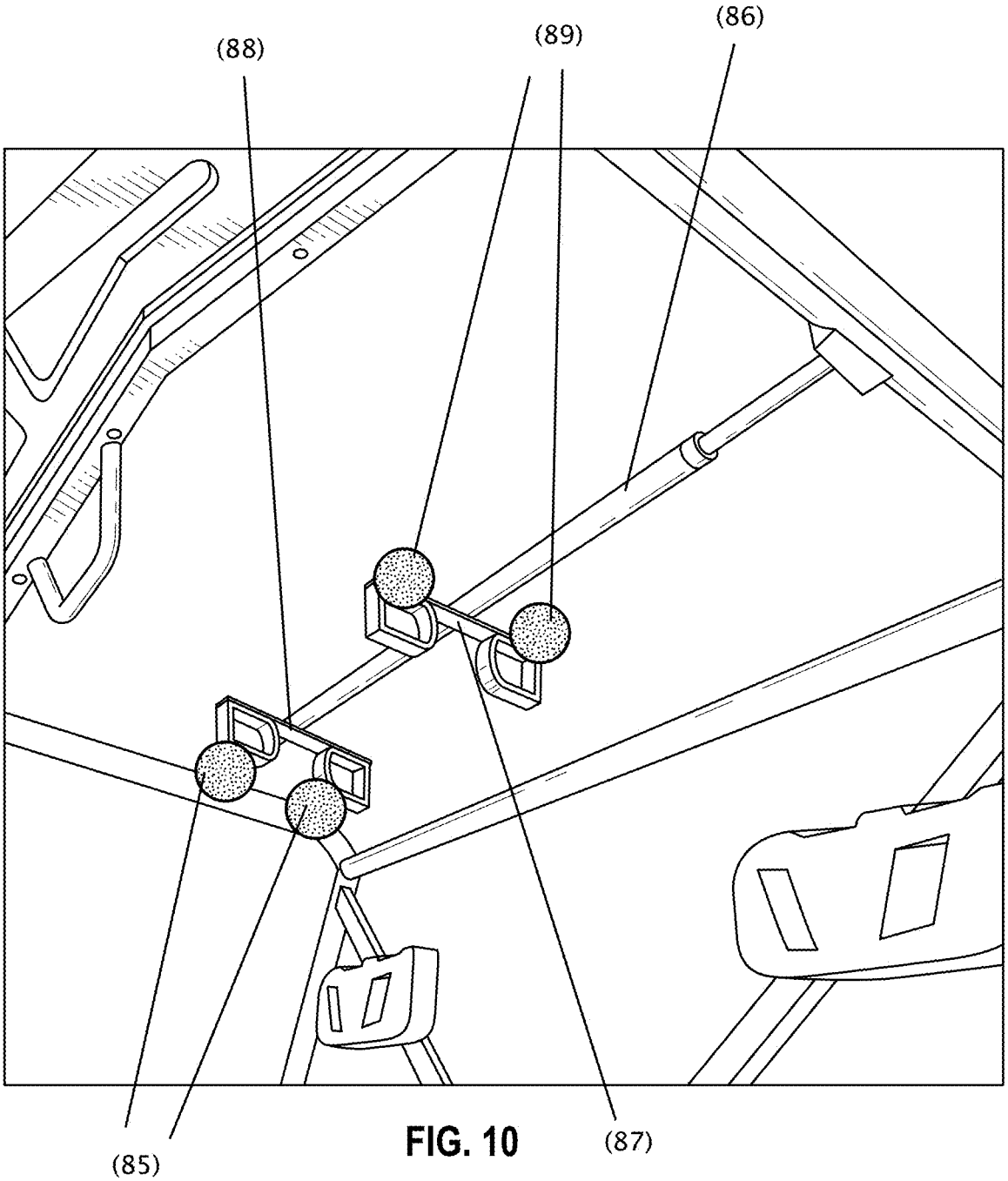
FIG. 10 shows the placement of magnets on a vehicle's roll-bar.

FIG. 10 shows the attachment points for magnets to support a set of rifles on under the roll bar of an open cockpit vehicle. The four attachment points are designated as Items (85) and (89). Item (86) designates a roll bar, which is secured on the vehicle and is over the driver. Item (87) designates a right-side dual support beam for the attachment of two support magnets, shown as Item (89). Item (88) designates a left-side dual support beam for the attachment of two support magnets, shown as Item (85).

Figure 11:
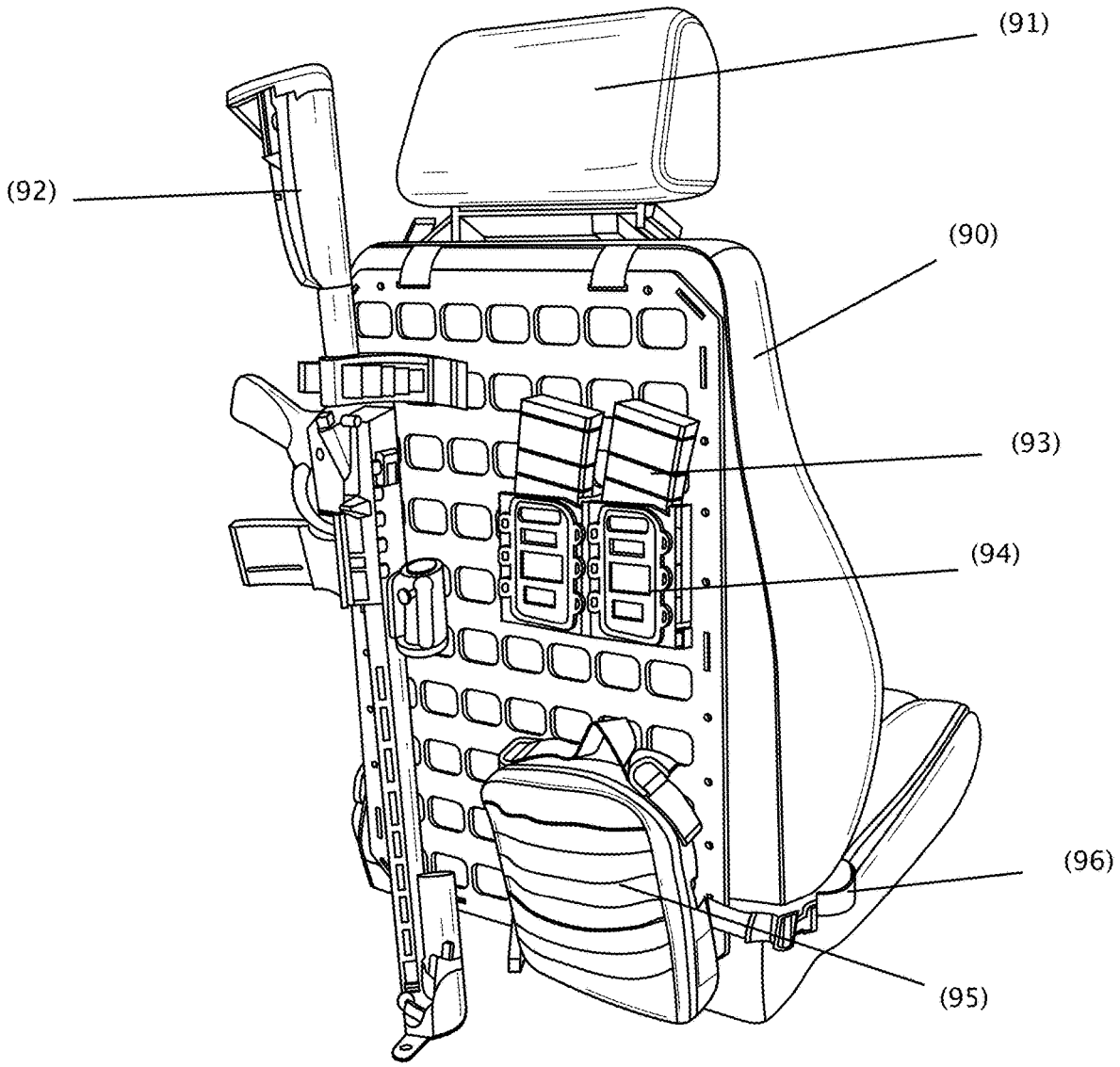
FIG. 11 shows equipment using the magnets on a vehicle chair.

FIG. 11 shows the conventional securement and outfitting for a military seat. Item (90) designates the seat while Item (91) designates the headrest. Item (96) designates the seat belt. Item (92) designates a rifle that is conventionally secured the seat. Item (93) designates a spare ammunition cartridge that is held in place by a metal pocket (Item (94)), which is secured to the seat. Item (95) designates an equipment satchel that is secured to the seat. In a preferred embodiment of the present invention, the rifle (Item (92)), spare ammunition cartridge (Item ((93)), and the equipment satchel (Item ((95)) are held in place with securement magnets.

Figure 12:
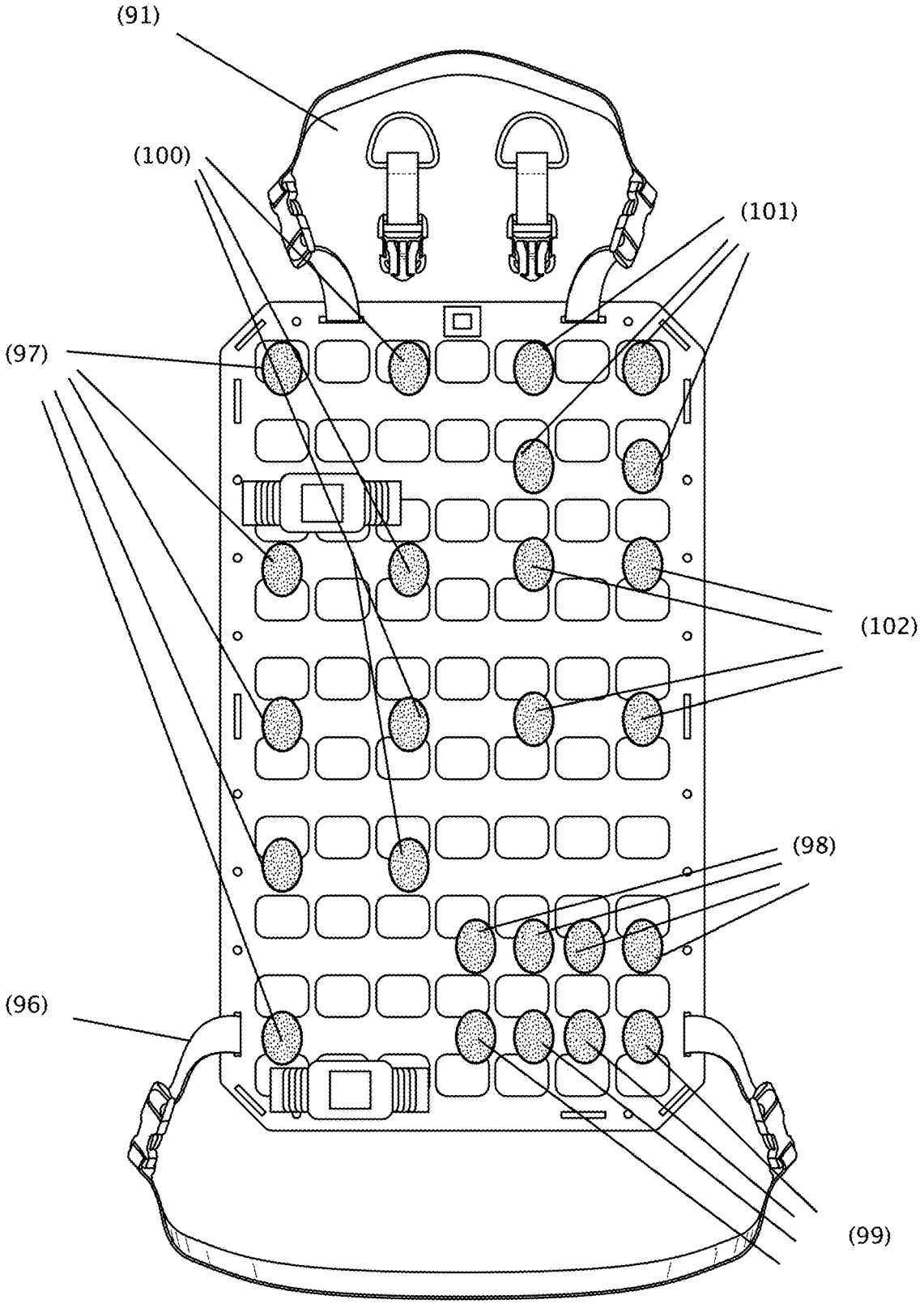
FIG. 12 shows the placement of magnets on a vehicle chair.

FIG. 12 shows an embodiment of the present invention which details the various magnet attachment points on the seat to secure the items from FIG. 11. For reference, Item (91) designates the headrest and Item (96) designates the seat belt. Item (97) designates the five magnetic attachment sites, which would secure the rifle, as shown on FIG. 11 as Item (92). A similar set of vertically placed attachment sites (Item (100)) would secure a second rifle, although the rifle is not depicted.

Item (98) designates the top row of four magnetic attachment sites while Item (99) designates the top row of four magnetic attachment sites. Taken together, the eight magnetic attachment sites depicted as Items (98) and (99) would secure the equipment satchel, as shown on FIG. 11 as Item (95).

Both Items (101) and (102) each designate a series of four magnetic attachment sites. Two of these would be enough to secure a single spare ammunition cartridge, as shown in FIG. 11 as Item ((93). The series of eight could secure at least four, possibly eight ammunition cartridges.

Figure 13:
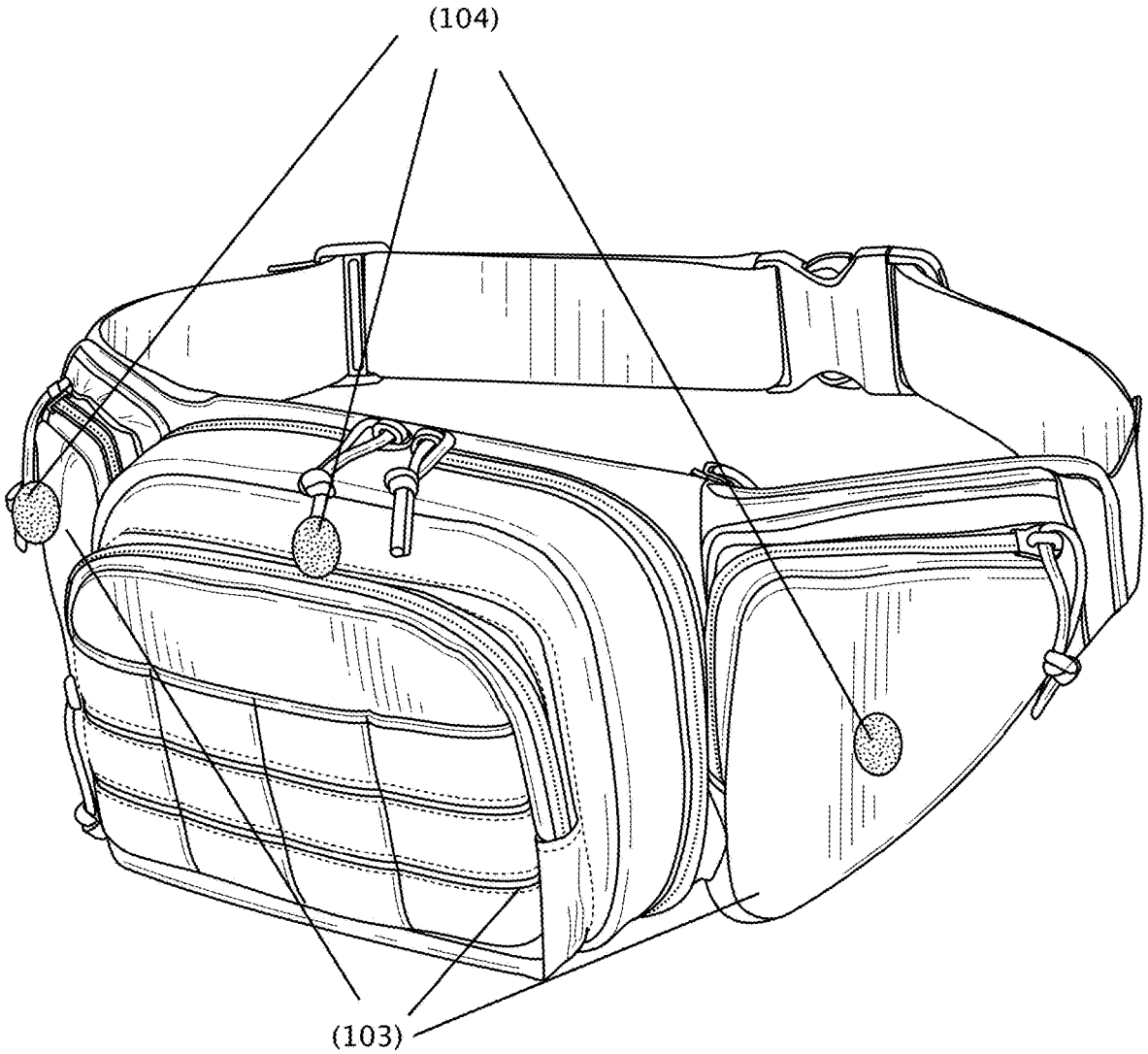
FIG. 13 shows the placement of magnets on a utility belt.

FIG. 13 depicts a utility belt with three satchel pockets, shown as Item (103). Each of these satchel pockets is supported by a magnet, the placement of which is identified as Item (104).

Figure 14:
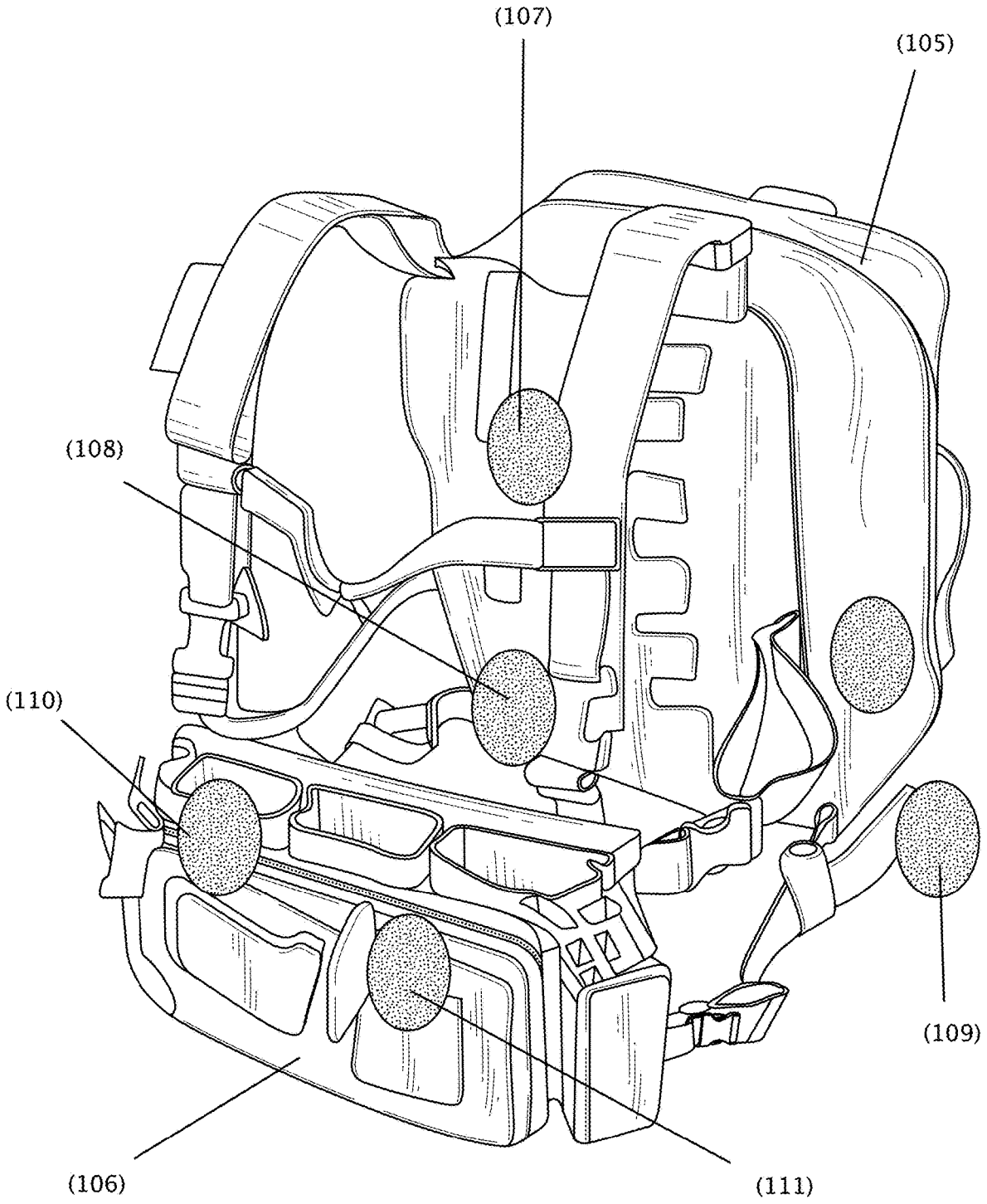
FIG. 14 shows the placement of magnets on a backpack.

FIG. 14 depicts a backpack (Item (105)) and utility satchel (Item (106)) with the placement of magnetic attachments demarcated. In particular, Item (107) depicts a securement site in the middle of the backpack. Item (108) depicts an attachment site on the lower right of the backpack. Item (109) depicts an attachment site on the lower left of the backpack. Items (110) and (111) depict attachment sites on the front right and front left of the utility satchel, respectively.

Figure 15:
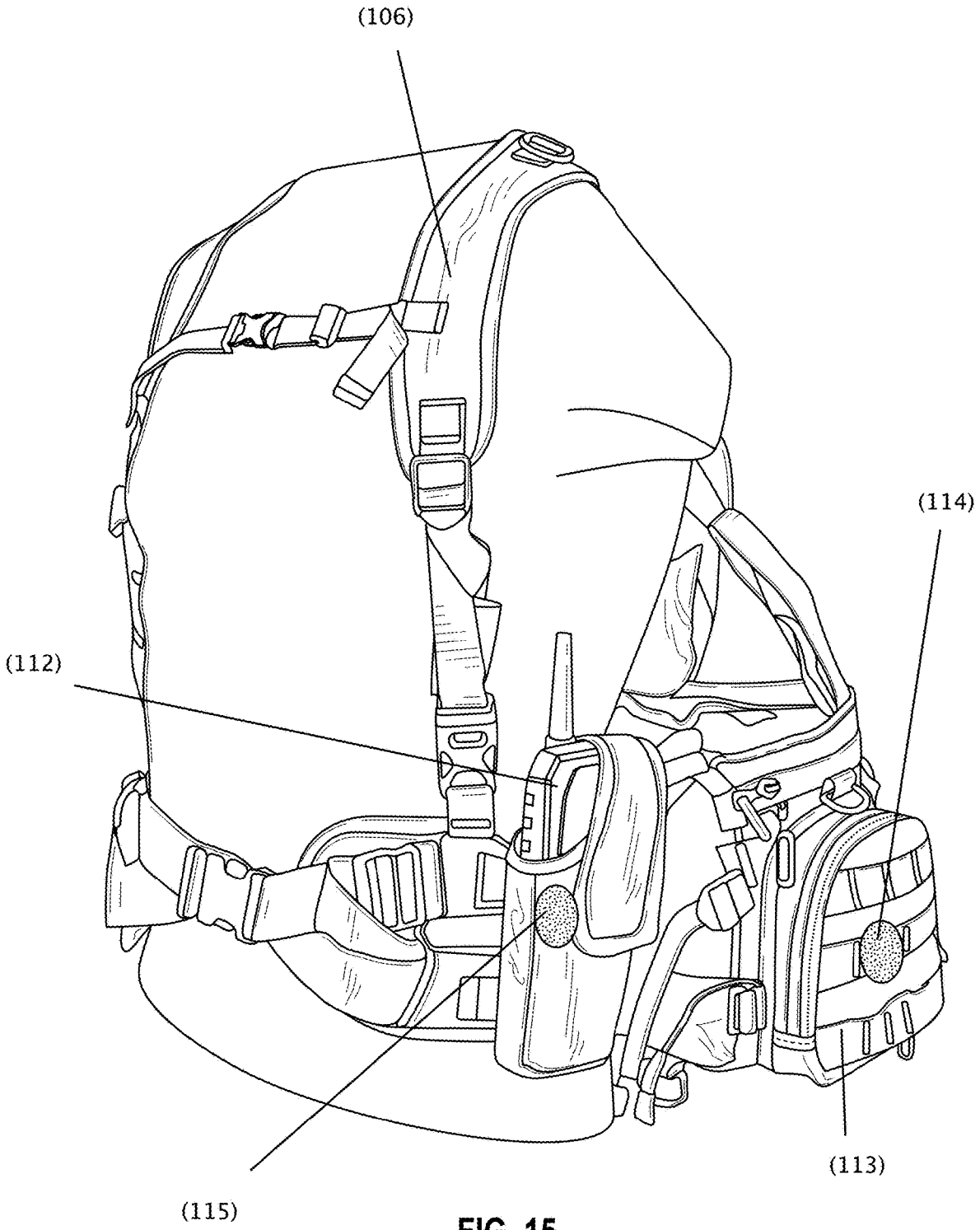
FIG. 15 shows the placement of magnets on a backpack.

FIG. 15 depicts a utility vest that has a radio (Item (112)) and a rear utility satchel (Item 113)). As shown, a magnet (Item (115)) attaches the radio while another (Item (114)) attaches the utility satchel.

Figure 16:
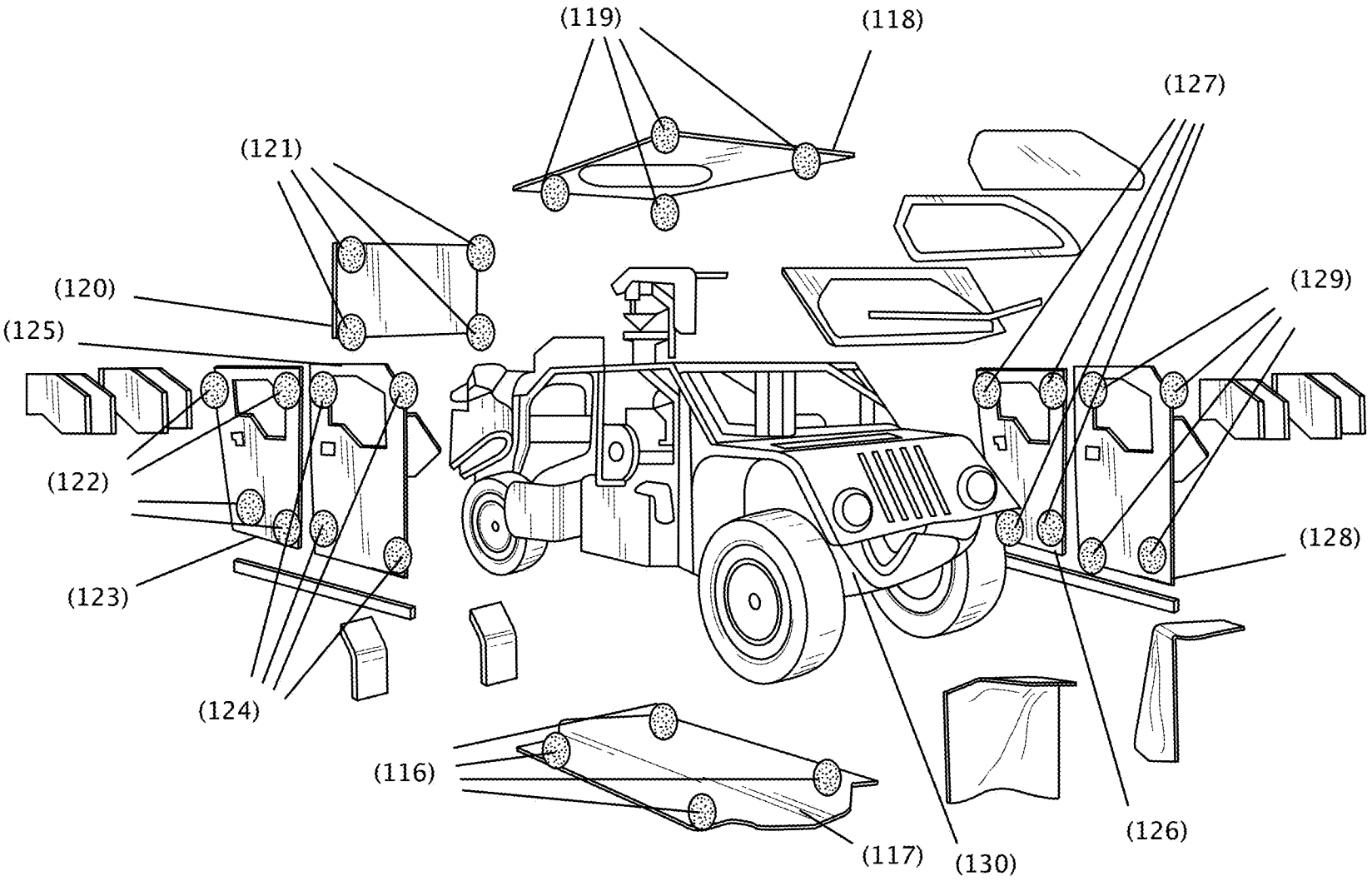
FIG. 16 shows the placement of magnets on the various components of a military vehicle.

It is envisioned that the present invention can be utilized to secure armor to vehicles. FIG. 16 depicts the magnet attachment sites for a High Mobility Multipurpose Wheeled Vehicle (i.e., "Humvee") with this invention. Item (117) depicts an armor plate that is designed for the underside of the vehicle while Item (116) depicts four attachment points at the corners of the plate to secure to the underside of the vehicle.

Item (118) depicts an armor plate that is designed for the rooftop of the vehicle while Item (119) depicts four attachment points at the corners of the plate to secure to the topside of the vehicle.

Item (120) depicts an armor plate that is designed for the rear of the vehicle while Item (121) depicts four attachment points at the corners of the plate to secure to the topside of the vehicle.

Item (123) depicts an armor plate that is designed for the right-rear door of the vehicle while Item (122) depicts four attachment points at the corners of the plate to secure to the door frame.

Item (125) depicts an armor plate that is designed for the right-front door of the vehicle while Item (124) depicts four attachment points at the corners of the plate to secure to the door frame.

Item (126) depicts an armor plate that is designed for the left-rear door of the vehicle while Item (127) depicts four attachment points at the corners of the plate to secure to the door frame.

Item (128) depicts an armor plate that is designed for the left-front door of the vehicle while Item (129) depicts four attachment points at the corners of the plate to secure to the door frame.

Item (130) depicts the vehicle.

Figure 17:
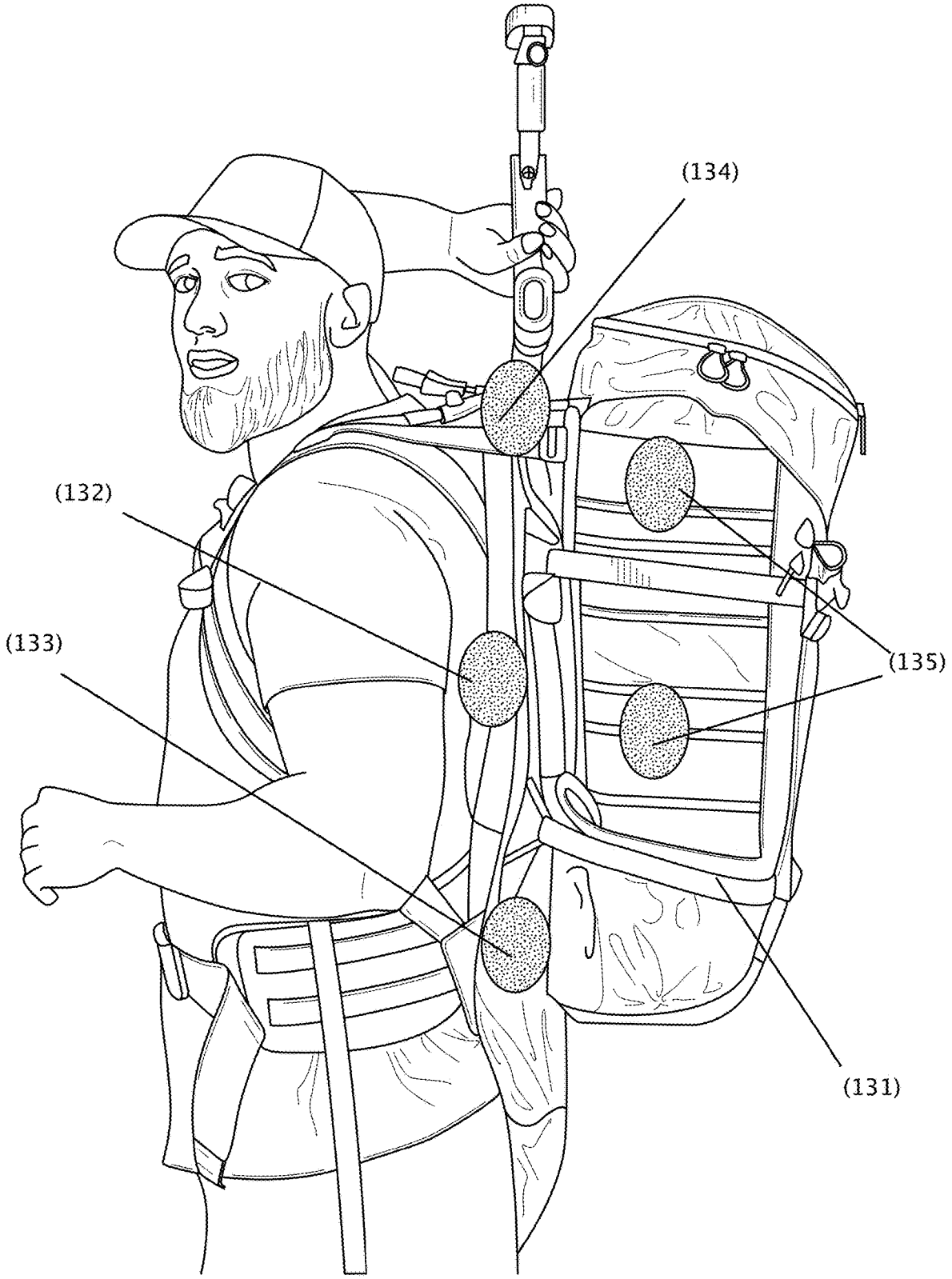
FIG. 17 shows the placement of magnets on a backpack.

FIG. 17 depicts a soldier utilizing the invention with a rucksack. Item (131) depicts the rucksack. Items (132) and (133) designate magnetic attachment points to secure the rucksack to the soldier. In a preferred embodiment, the soldier is wearing a vest with a magnet to secure it to a matching magnet on the rucksack. Item (134) depicts a magnet site for the attachment of a rifle to the rucksack. Item (135) depicts two magnet sites for the attachment of equipment to the rucksack.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

It will be apparent to those skilled in the art that other embodiments of the invention will be apparent to those skilled in the art from consideration of the specification and practice of the invention. While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope of the invention. It is intended that the specification and examples be considered as exemplary, with the true scope of the invention being indicated by the claims.

I claim:

1. A means for securing tactical equipment to a garment, comprising:

a garment that contains at least one first magnet, wherein said first magnet is embedded within or attached to one or more regions around said garment;

wherein said garment is composed of non-magnetic fabric materials;

at least one piece of tactical equipment selected from the group consisting of a firearm, ammunition clips, set of binoculars, set of night vision goggles, radio equipment, knives and utility knives, hydration bottles, communication devices, survival gear, hydration bottles, thermal imaging devices, or bulletproof vests;

at least one reciprocal magnetic attachment, wherein said reciprocal magnetic attachment is secured to said piece of tactical equipment, and, wherein said reciprocal magnetic attachment is either a second magnet mounted using a rubber mount for securing lighter weight tactical gear items or a steel plate to secure heavier weight tactical gear items.

2. The means for securing tactical equipment of claim 1, wherein said garment is selected from the group consisting of a helmet, a vest, a set of trousers, a shirt, a uniform, a pair of shorts, a pair of gloves, a pair of knee pads, or a belt.

3. The means for securing tactical equipment of claim 1, wherein said first magnet is composed of neodymium, boron, and iron.

4. The means for securing tactical equipment of claim 1, wherein said first magnet is composed of samarium and cobalt.

5. A means for securing tactical equipment to a vehicle, comprising:

a vehicle frame;

at least one first magnet, wherein said first magnet is attached to one or more regions around said vehicle frame;

at least one piece of tactical equipment selected from the group consisting of a firearm, ammunition clips, set of binoculars, set of night vision goggles, radio equipment, knives and utility knives, hydration bottles, communication devices, survival gear, hydration bottles, thermal imaging devices, or bulletproof vests;

at least one reciprocal magnetic attachment, wherein said reciprocal magnetic attachment is secured to said piece of tactical equipment; and, wherein said reciprocal magnetic attachment is either a second magnet mounted using a rubber mount for securing lighter weight tactical gear items or a steel plate to secure heavier weight tactical gear items.

6. The means for securing tactical equipment to a vehicle of claim 5, wherein said vehicle frame is selected from the group consisting of a door, a chassis frame, a roll-bar, a hood, a door, or a seat within the vehicle.

7. The means for securing tactical equipment to a vehicle of claim 5, wherein said first magnet is composed of neodymium, boron, and iron.

8. The means for securing tactical equipment to a vehicle of claim 5, wherein said first magnet is composed of samarium and cobalt.

* * * * *